United States Patent [19]

Higuchi et al.

[11] Patent Number: 4,926,504

[45] Date of Patent: May 22, 1990

[54] TOILET SEAT STRUCTURE CAPABLE OF AUTOMATICALLY FEEDING A SEAT COVERING PAPER ONTO A TOILET SEAT

[75] Inventors: Mitsuhiro Higuchi; Hirofumi Yamamoto, both of Kitakyushu, Japan

[73] Assignee: Toto Ltd., Kitakyushu, Japan

[21] Appl. No.: 197,531

[22] Filed: May 23, 1988

[30] Foreign Application Priority Data

| | | | |
|---|---|---|---|
| May 28, 1987 | [JP] | Japan | 62-134531 |
| Aug. 22, 1987 | [JP] | Japan | 62-208537 |
| Oct. 28, 1987 | [JP] | Japan | 62-165962[U] |
| Dec. 18, 1987 | [JP] | Japan | 62-322571 |

[51] Int. Cl.[5] ..... A47K 13/20

[52] U.S. Cl. ..... 4/247; 4/243

[58] Field of Search ..... 4/247, 242, 243, 244, 4/245, 246; 200/61.7

[56] References Cited

U.S. PATENT DOCUMENTS

| | | | |
|---|---|---|---|
| 1,487,448 | 3/1924 | Duarte | 4/247 |
| 1,589,429 | 6/1926 | Rouse | 4/247 |
| 2,123,012 | 7/1938 | Kreutzig | 4/247 |
| 2,342,048 | 2/1944 | Halfin | 4/247 |
| 4,106,135 | 8/1978 | Mannheim | 4/247 |
| 4,264,793 | 4/1981 | Mailloux | 200/61.7 |
| 4,760,613 | 8/1988 | Bobak | 4/247 |
| 4,766,618 | 8/1988 | Boker | 4/247 |
| 4,769,859 | 9/1988 | Bobak | 4/247 |

FOREIGN PATENT DOCUMENTS

| | | |
|---|---|---|
| 55-179600 | 12/1980 | Japan . |
| 57-29174 | 6/1982 | Japan . |
| 60-155399 | 10/1985 | Japan . |

*Primary Examiner*—Henry J. Recla
*Assistant Examiner*—Edward C. Donovan
*Attorney, Agent, or Firm*—Jordan and Hamburg

[57] ABSTRACT

A toilet seat structure capable of automatically feeding a seat covering paper onto the toilet seat is disclosed. Since the sheet paper feeding mechanism and a paper cutting mechanism operated by an electronic control unit. A specified length of paper appropriate for covering the toilet seat is automatically and accurately fed and positioned on the toilet seat. After use, the seat covering paper can automatically be cut off. For lavatories at public sites in particular, since the user can operate the apparatus to feed the paper from a functional casing to provide a new seat covering paper on the toilet seat for each use, the user can be assured of a clean toilet seat. Also, since the seat covering paper is held immovable on the toilet seat, the use of the paper covered toilet is made easier.

2 Claims, 13 Drawing Sheets

TOILET SEAT STRUCTURE CAPABLE OF AUTOMATICALLY FEEDING A SEAT COVERING PAPER ONTO A TOILET SEAT

BACKGROUND OF THE INVENTION

The present invention relates to a toilet seat structure capable of automatically feeding a seat covering paper onto a toilet seat.

Conventionally, the following methods or apparatuses have been available for setting a seat covering paper on a toilet seat for the purpose of hygiene.

(1) A method in which a plurality of seat covering paper which are folded in four and contained in a paper holder hung on the wall are taken out one sheet at a time and set on the toilet seat.

(2) An apparatus like the one disclosed in the Japanese Utility Model Laid-Open Publication No. 179600/1980. The apparatus has a container in the toilet seat cover for storing a roll of paper. The paper is drawn out from the container onto the seat. The drawn-out portion which functions as a seat covering paper is spread over the toilet seat and is held and cut off from the roll of paper when a person sits on the seat due to the weight of the person.

(3) An apparatus like the one disclosed in the Japanese Utility Model Laid-Open Publication No. 155399/1985. The apparatus comprises (a) a seat covering paper holder which stores a continuous sheet made of a plurality of seat covering papers in folded manner or in the form of a roll each seat paper covering having has a size and shape sufficient to cover the upper surface of the toilet seat, (b) a feed roller which is provided on the feeding side of the seat covering paper holder to feed a specified length of paper corresponding to one seat covering paper, over the upper surface of the toilet seat and (c) a cutter for cutting the rear end of the specified length of paper sheet.

(4) An apparatus like the one disclosed in the Japanese Patent Publication No. 29174/1982. The apparatus has near one end of the toilet seat, a device for feeding a tube made of a plastic film and, near the other end a pickup device for the tube. The tube is contained in the tube feeding device and is fed by manipulating a switch connected to a driver for the tube pickup device.

The conventional methods and apparatuses described above have the following drawbacks.

(a) As to the first method (1), no means is provided to hold the seat covering paper in position on the toilet seat, so that it is very difficult to cover the toilet seat with the seat covering paper as it easily slips from the toilet seat.

Since the seat covering paper is not held on the toilet seat, the seat covering paper is difficult to position in a correct location as it is affected by even weak air currents. Namely, in this method, handling of the seat covering paper is difficult.

Further, since the seat covering paper is stored in a folded condition, when the seat covering paper is unfolded for use, the seat covering paper remains bent along the folding lines, so that it will easily fall from the toilet seat and will not stably rest on the toilet seat.

Moreover, after use, as the seat covering paper is not held in position, the seat covering paper will stick to the buttocks, which is another nuisance experienced by the user.

(b) Regarding the second apparatus (2), the paper has to be fed manually to the toilet seat and this is inconvenient for the user. Also, depending on the manner in which the user sits on the toilet seat, there is a possibility that the paper cannot reliably be cut to provide a seat covering paper.

Since the feeding of the paper is done manually, some user may not stop the feeding at a specified position. Namely, the perforated line for cutting may not be located at an appropriate position and deviate from it. In that case, the paper cannot be cut.

Furthermore, a part of the sheet paper is always exposed through the takeout opening for easy pickup, so that running water or foul water from the toilet may adhere to the exposed part of the paper, which is then touched by hand for the next use. Therefore this apparatus is not hygienic.

(c) As to the third apparatus (3), the feeding of the paper is done by the on/off operation of the feed switch and not through a control unit such as a central processing unit, so that the length of paper fed onto the toilet seat will vary from one feeding operation to another and the exact specified length of paper cannot be drawn out at each feeding operation. Also, since the paper cutting is done by the on/off operation of the cutting switch and not through a control unit such as the central processing unit automatically, this apparatus is not easy to handle. Furthermore, since the seat covering paper roll and the feed roller are constructed separately or apart from the toilet seat, they require a separate or independent installation space, leaving less room for the toilet.

(d) As to the fourth apparatus (4), to prevent possible damages during feeding of the tube, is made of a plastic film which feels bad when touched. The tube is transferred and wound up between the tube feed device and the tube pickup device, so that it is not possible to know whether the tube on the seat is unused or used. The next user, therefore, will most likely feed the tube even when the tube on the sheet actually is not yet used. This is not economical.

Also, the toilet seat is supported in the form of a so-called cantilever with one end suspended in air and thus is not strong enough.

When the toilet seat is made heavier, the plastic film will be subjected to a heavy pressure between the toilet seat and the toilet bowl and may become inoperable.

Another disadvantage of this apparatus is that it cannot be used with the front-split type seat.

Moreover, since the used tube is wound up and stored in the casing, the apparatus is not hygienic.

Accordingly, it is an object of this invention to provide a toilet seat structure capable of automatically feeding the seat covering paper onto the toilet seat which can overcome the above-mentioned drawbacks.

In summary, the present invention provides a toilet seat structure capable of automatically feeding a seat covering paper onto the toilet seat which comprises: a roll of paper having a length capable of producing a plurality of seat cover papers; a paper feeding mechanism for feeding the paper from the paper roll onto the upper surface of a seat body; a sheet paper cutting mechanism for cutting the paper at a position a predetermined distance away from the front end of the paper to provide a piece of seat covering paper onto the seat body; an electronic control unit for controlling the operation of the paper feeding mechanism and the paper cutting mechanism to feed a specified length of paper onto the seat body and cut the paper fed onto the seat body to produce the seat cover paper; a control board for transmitting control signal to the electronic control unit; and a functional casing provided at the rear of the seat body, and a functional casing containing all the above constitutional elements as one unit.

With the above construction, the invention has the following features.

(1) Since the paper feeding mechanism and the seat paper cutting mechanism are operated by the electronic control unit a specified length of, paper can be automatically and accurately fed and be positioned accurately on the toilet seat. After use, the seat covering paper can automatically be cut off. For lavatories at public sites in particular, since the user can draw out the paper from the functional casing to provide a new seat covering paper on the toilet seat for each use, the user can be assured of a clean toilet seat. Also, since the seat covering paper is held immovably on the toilet seat, the use of the paper covered toilet seat is made easier.

(2) Since the paper roll, the paper feeding mechanism, the paper cutting mechanism, the electronic control unit for controlling the paper feeding mechanism and the paper cutting mechanism, and the control board for activating the control unit are all installed as one unit in the functional casing provided at the rear of the toilet seat, the toilet seat structure as a whole with many functions can be made small, assuring the maximum possible space in the toilet room. The larger space available in turn contributes to easier handling of the apparatus. Because the apparatus is made compact, it can be applied to any type toilet and also be installed on existing toilets with a simple procedure of replacing the old seat.

BEST MODE FOR CARRYING OUT THE PRESENT INVENTION

Now, the present invention will be described by referring to the attached drawings.

Figure 1:
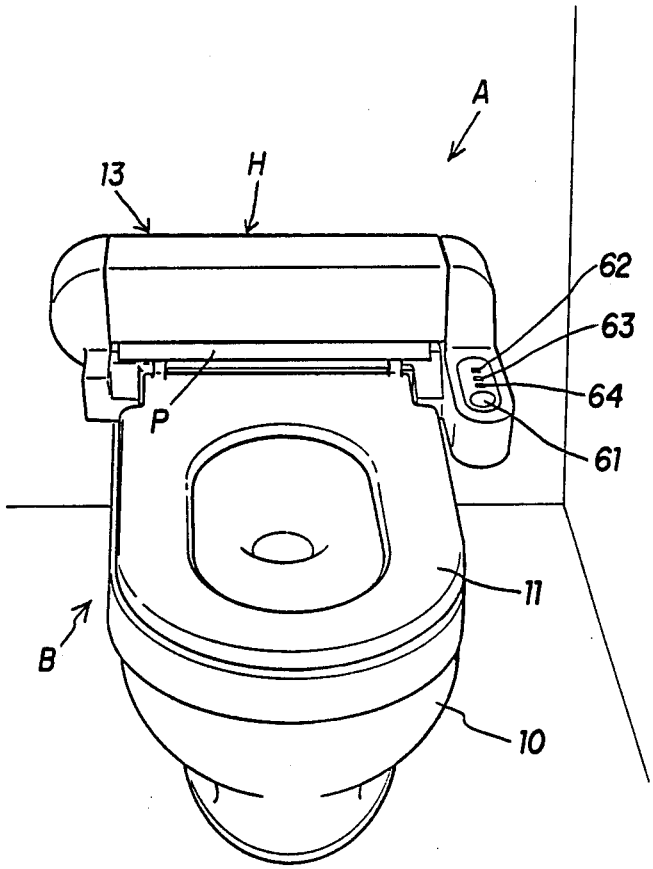
FIG. 1 is an overall perspective view of a toilet apparatus equipped with the toilet seat structure of the present invention.

FIG. 1 shows the overall construction of a toilet apparatus B equipped with a toilet seat structure A of the present invention which is capable of automatically feeding or providing a seat covering paper on the toilet seat.

Hereinafter, such toilet seat structure A is referred to as the automatic seat covering paper feeding toilet seat A.

As shown, the automatic seat covering paper feeding toilet seat A is mounted on a flush toilet bowl 10 which forms the toilet apparatus B so that it can be opened and closed vertically.

Referring to FIGS. 2 through 5, the construction of the automatic seat covering paper feeding toilet seat A is explained.

As shown in these figures, the automatic paper feeding toilet seat A consists of a seat body 11 and a functional section 13.

The seat body 11 is mounted on the flush toilet bowl 10 so that it can be opened and closed. The functional section 13 is securely mounted on the rear part of the flush toilet bowl 10. The functional section 13 has the rear portion of the seat body 11 connected vertically pivotably to its front part through a pivot shaft 12.

As shown in FIGS. 2 through 5, the functional section 13 is mounted on the rear of the flush toilet bowl 10 and consists of: an L-shaped, as viewed from above mounting base 20 formed of a rectangular plate with one end portion bent at right angle forwardly toward the seat body 11; a paper feeding mechanism C mounted on the mounting base 20; a paper cutting mechanism D; a paper roll storage section E; an electronic control unit F; and a control board G.

First, the paper feeding mechanism C and the paper cutting mechanism D will be explained.

Figure 2:
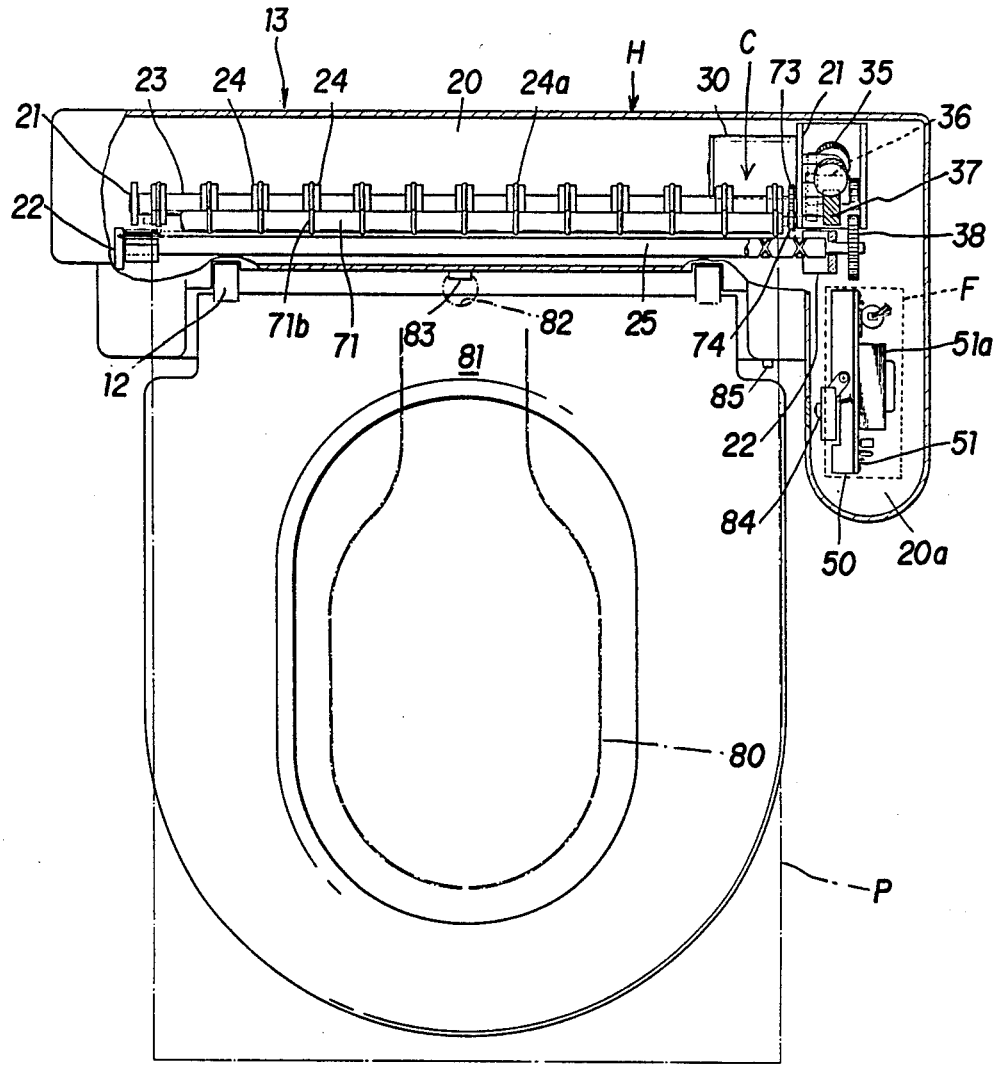
FIG. 2 is a partially cutaway plan view of the toilet seat.
Figure 3:
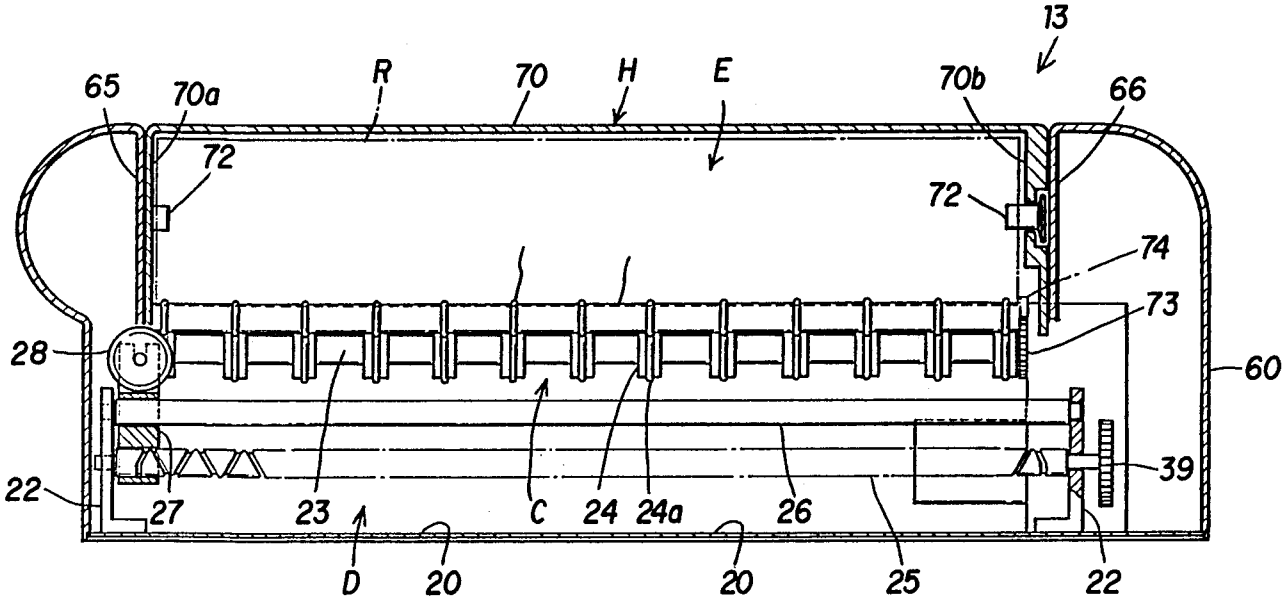
FIG. 3 is a partially cutaway front view of the toilet seat.

As is seen from FIGS. 2 and 3, the mounting base 20 has rotating shaft support plates 21, 22 erected on each side, between which a plurality of rotating shafts are rotatably and horizontally supported.

That is, reference numeral 23 denotes a paper feeding shaft horizontally supported between the front upper part of the support plates 21. The paper feeding shaft 23 has a plurality of feed rollers 24 along its length at specified intervals.

The feed rollers 24 cooperate with a press roller 71 described later to hold the pickup end or external end of the paper P between them and feed the paper P from the seat covering paper storage portion E onto the seat body 11.

Since a large number of feed rollers 24 are arranged along the length of the shaft 23 at specified intervals, the paper P can be drawn out at the same speed and under the same pressure over its entire width effectively preventing it from being twisted.

Figure 4:
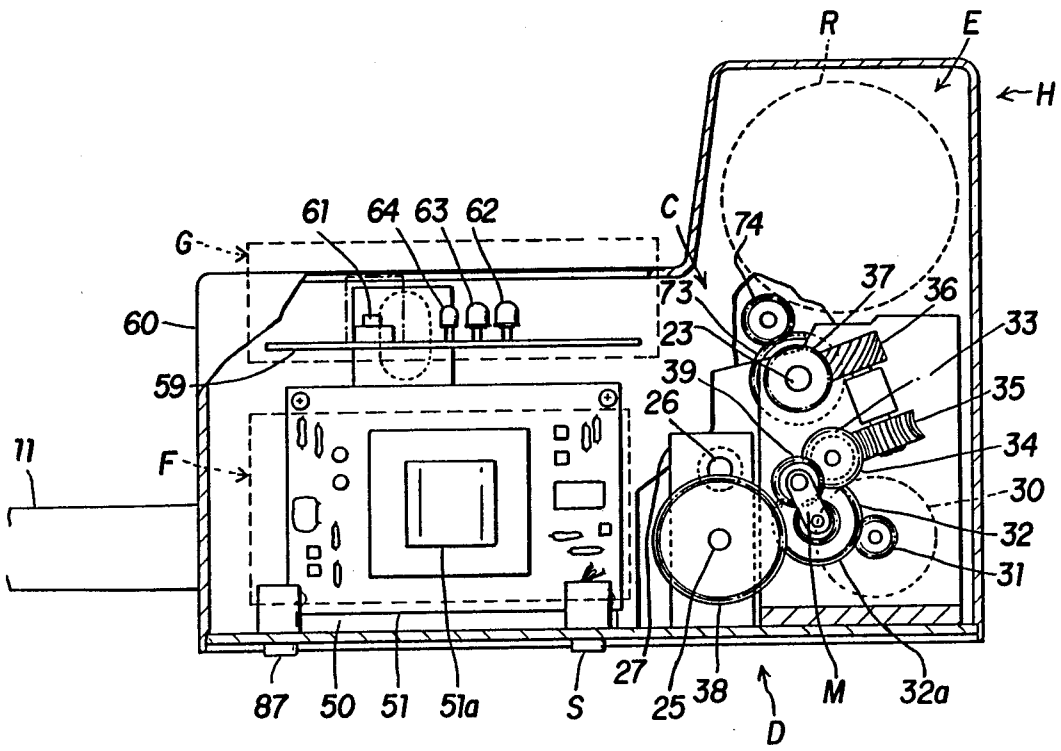
FIG. 4 is a partially cutaway right side view of the toilet seat.
Figure 5:
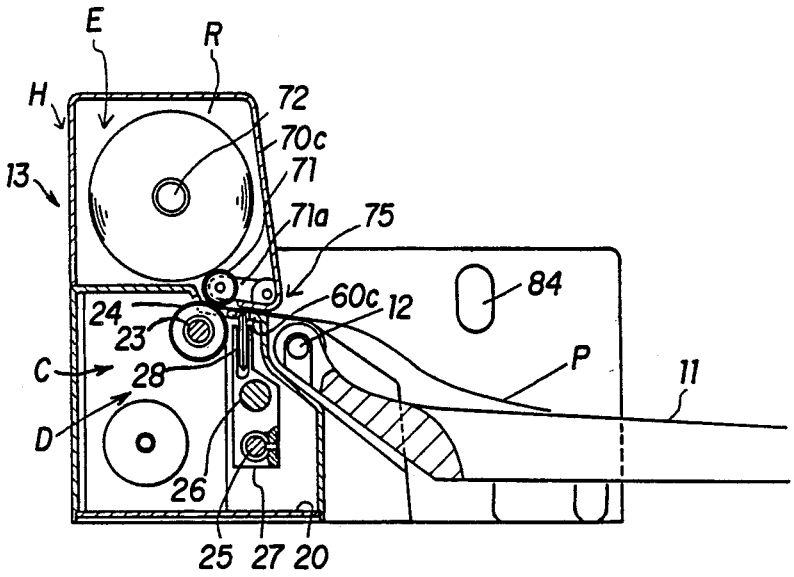
FIG. 5 is a partially cutaway left side view of the toilet seat.

Attached to end of these feed rollers 24 is an O-ring **24*a* to prevent slippage or idle running of the rollers 24. The slippage and idle rotation of the feed rollers 24 can also be prevented by forming the feed rollers 24 themselves out of rubber. The use of a rubber belt will also provide the same effect. In FIGS. 4 and 5, reference numeral 25 designates a cutting blade traversing shaft supported between the lower front portions of the support plates 22. Immediately above the shaft 25 is installed a cutting blade guide shaft 26** which is in the form of a solid bar.

Supported on the cutting blade traversing shaft 25 and also on the cutting blade guide shaft 26 is a cutting blade mounting plate 27 which is in threaded engagement with the cutting blade traversing shaft 25.

A disk-shaped cutting blade 28 is rotatably mounted on the upper end of the cutting blade mounting plate 27.

In the above construction, as the cutting blade traversing shaft 25 is rotated, the cutting blade 28 together with the cutting blade mounting plate 27 is axially moved instantaneously cutting the sheet paper P to provide a seat covering paper P-1.

The mechanism for moving the cutting blade 28 may be replaced with a construction in which an endless wire or endless belt is driven by a motor and reciprocally moved widthwise to the left and right with the cutting blade 28 rigidly secured to the endless wire.

Figure 7:
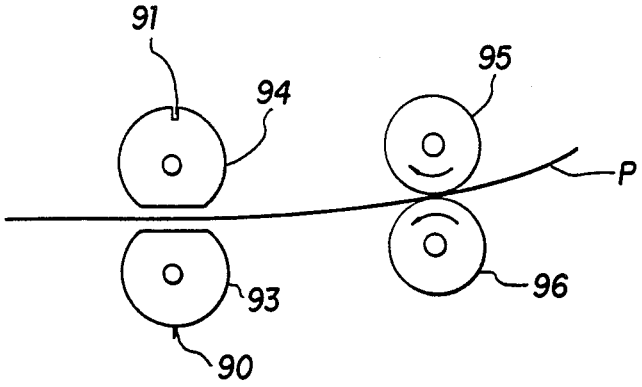
FIGS. 7 and 8 are explanatory views of a variation of the cutting blade showing how it is used.
Figure 8:
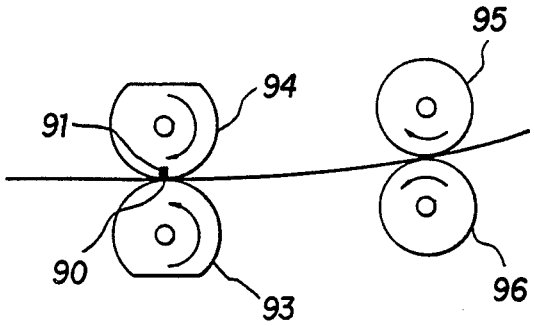

The method of cutting the paper P by reciprocating the cutting blade 28 may be replaced by a method in which rotatable shafts 93, 94 fitted with a cutting blade 90 and a mating groove 91 are rotated to cut the seat covering paper P, as shown in FIGS. 7 and 8. The rotating angle of these shafts 93, 94 may be other than 180°.

FIG. 7 shows the rotatable shafts 93, 94 with the paper P being fed therebetween. FIG. 8 shows the rotatable shafts 93, 94 holding and cutting the paper P fed therebetween. Reference numerals 95 and 96 designate a pair of feed rollers.

While in this embodiment the cutting blade 28 is disk-shaped to obtain good durability, it may be formed in a plate shape.

In FIGS. 2 and 4, denoted 30 is a power-operated motor which can selectively rotate the paper feeding shaft 23 and the cutting blade traversing shaft 25 through a cluth mechanism M. Switching of the clutch mechanism M between the paper feeding shaft 23 and the cutting blade traversing shaft 25 is performed by changing the rotation direction of the motor 30, forward or reverse. In this embodiment the motor 30 is rigidly mounted to the support plate 21 located at one thereof.

The rotation of the motor 30 is transmitted to the paper feeding shaft 23 from a gear 31 secured to the output shaft of the motor 30 through gear train 32, 33, 34, 35, 36 and to a gear 37 secured to the paper feeding shaft 23.

Transmission of the rotation of the motor 30 to the cutting blade moving shaft 25 consists of disengaging the gear 32 from the gear 33 by reversing the motor 30 through the clutch mechanism M, and bringing the gear 39 which is in mesh with a gear **32*a* integrally formed with the gear 32 into a meshing engagement with a gear which is securely mounted on the cutting blade moving shaft 25**.

That is, the rotation of the motor 30 is transmitted through the gears **31, 32, 32*a*, 39, 38 to the cutting blade traversing shaft 25**.

The single motor 30 is driven forward or backward to activate the clutch mechanism M and thereby to selectively perform the feeding of the paper P and the cutting thereof.

However, the paper feeding and the cutting can also be done by using dedicated motors.

Transmission of the rotation of the motor 30 to the seat covering paper feeding shaft 23 and to the cutting blade traversing shaft 25 can also be accomplished through a belt or wire rather than through the gear train.

Next, we will explain the construction of the electronic control unit F that controls the operation of the paper feeding mechanism C and the paper cutting mechanism D.

Figure 9:
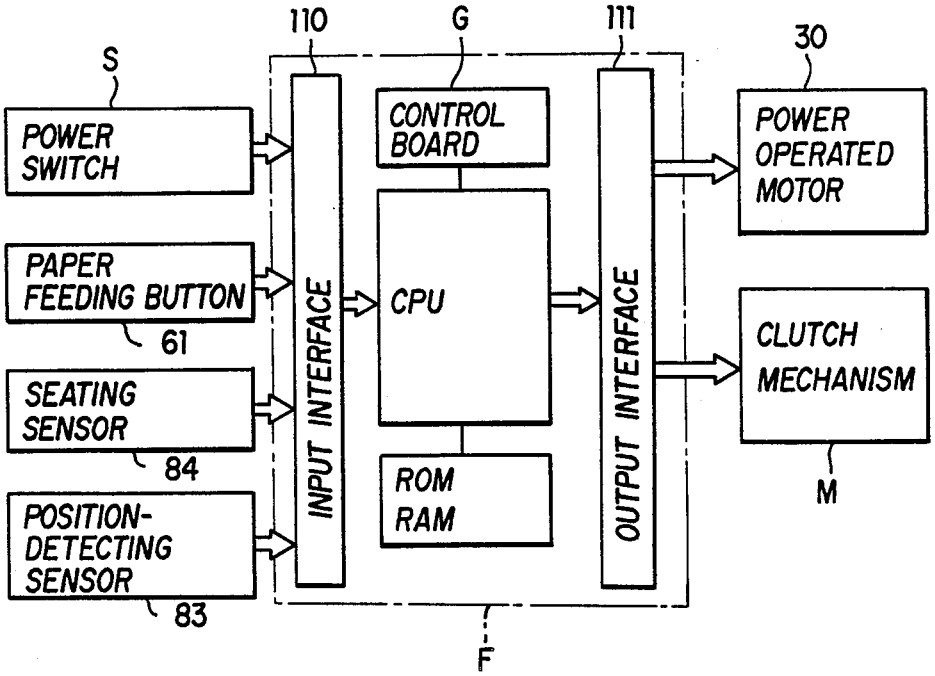
FIG. 9 is a block diagram of the control unit.

As shown in FIG. 9, the control unit F comprises a central processing unit CPU, an input interface 110, an output interface 111 and a memory or a storing device (ROM RAM) which stores the program for sequentially carrying out the paper feeding and cutting operations.

The input interface 110 is interposed between the paper feeding pushbutton 61, a position-detecting sensor 83 or other switches and the central control unit F, while the output interface 111 is interposed between the power-operated motor 30 and the central processing unit CPU.

As shown in FIGS. 2 and 4, at the forward extension **20*a* that extends forwardly from one side of the mounting base 20, a control-unit mounting plate 50 is erected. The control-unit mounting plate 50 is electrically connected with a control board 51 which transmits control signals to the control unit F to control the operation of the motor 30. The control board 51 incorporates a transformer 51*a***.

The paper feeding mechanism C, the paper cutting mechanism D and the control unit F which are all arranged as one unit on the mounting base 20 are enclosed by a cover casing 60 which is L-shaped in outline as with the mounting base 20.

Now, we explain the control board G. As is clearly seen from FIG. 4, the control board G is provided in the cover casing 60 above the control unit F. The control board G consists of: a paper feeding pushbutton 61, a power lamp 62 which is a light emitting diode, a paper roll loading lamp 63 with an alarm function indicating when paper clogging occurs or when a new paper roll must be loaded, and a paper clogging lamp 64, all installed in the cover casing 60.

It is possible to attach a buzzer in place of the paper roll loading lamp 63.

As shown in FIGS. 3, 4 and 5, a paper roll storage section E is provided above the paper feeding mechanism C.

The paper roll storage section E consists of: a paper roll storage box 70 removably mounted in a space formed between side walls 65, 66 erected integrally from the upper surface of the cover casing 60 on each side; a paper roll R replaceably installed in the storage box 70; and a press roller 71 horizontally disposed in the lower front of the paper roll storage box 70.

In the above construction, the paper roll storage box 70 has openings in its end walls **70*a*, 70*b* at each side that communicate with end openings of the center shaft of the paper roll R. Rotatably and removably mounted in the end walls 70*a*, 70*b* and inserted through the openings are connecting plugs 72 that support the paper roll R. By axially advancing or retracting the connecting plugs 72**, the paper roll R can be supported in position or removed with ease.

The connecting plugs 72 are prevented from being dislocated by the side walls 65, 66 of the cover casing 60.

The press roller 71 is in contact under pressure with the feed rollers 24 on the paper feeding shaft 23 of the paper feeding mechanism C. The gear 74 securely mounted on the press roller 71 at one end is in mesh with the gear 73 securely mounted on the corresponding end of the paper feeding shaft 23.

Under this construction, as the paper feeding shaft 23 and the feed rollers 24 rotate in one direction, the press roller 71 turns in the reverse direction through the gears 73, 74, feeding the paper P from the paper roll R.

The press roller 71 has O-rings 71*b* at positions corresponding to the feed rollers 24 to effectively prevent the idle turning or skidding of the feed rollers 24 and twisting of the paper P when the paper is being fed.

As shown in FIG. 5, the ends of the press roller 71 are rotatably supported on the free ends of oscillation levers 71*a* which have their base ends mounted vertically oscillatable on the lower portion of the front wall of the seat covering paper roll storage box 70.

The press roller 71 is in pressure contact with the feed rollers 24 and is formed of a material with a large specific gravity to make sure that the paper P is reliably fed out from the seat covering paper roll R.

In such a construction, the press roller 71 is kept in pressure contact with the feed rollers 24 by its own weight. The press roller 71 can be oscillated outside to allow easy mounting and removal of the seat covering paper roll R in and out of the storage box 70.

Referring to FIG. 5, between the upper wall 60*c* of the cover casing 60 and the lower end of the front wall 70*c* of the storage box 70 is formed a slit 75 through which the paper P is taken out.

The paper P unwound from the paper roll R in the sheet paper roll storage box 70 is, as shown in FIG. 5, bent outside by the press roller 71 to offset the curling of the roll R. After this, the straightened paper P passes between the press roller 71 and the feed rollers 24 and then through the slit 75 onto the seat body 11.

The seat covering paper roll storage box 70 and the cover casing 60 together form a functional casing H.

Figure 6:
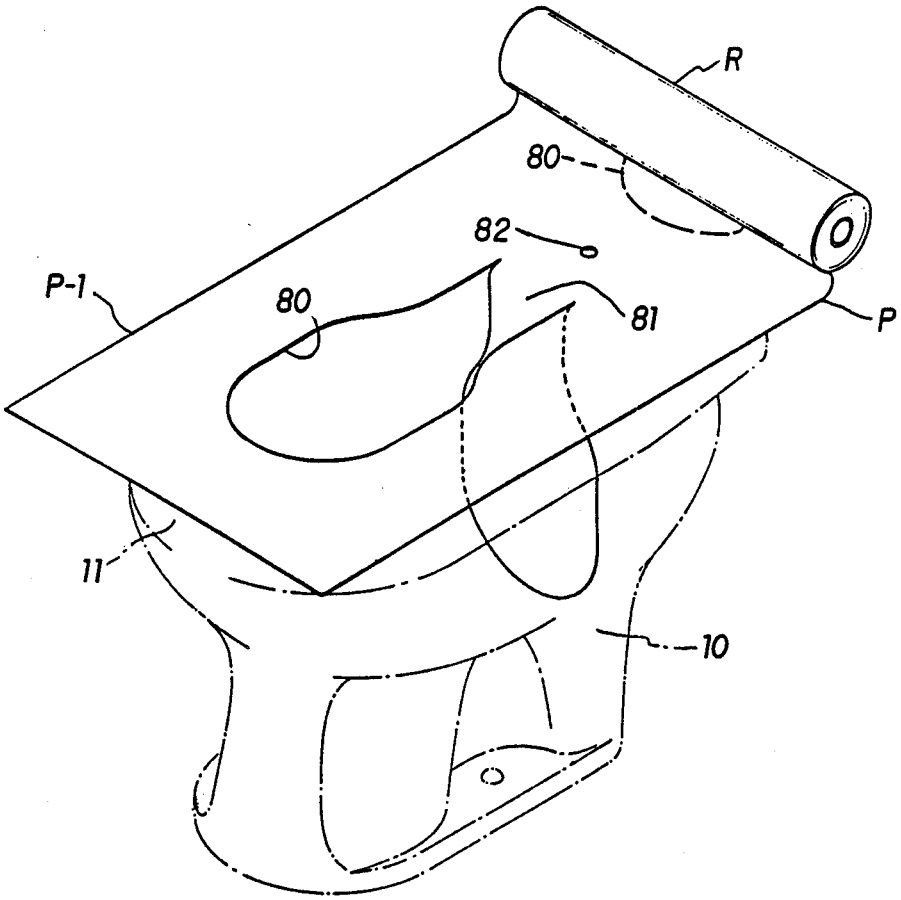
FIG. 6 is an explanatory view showing how the seat covering paper is used on the toilet seat.

Next, explanation will be made of the paper P. As shown in FIGS. 4 and 6, the paper P is in the form of a paper roll R and is cut for use.

The reason that the paper P is in the form of the roll R is that the seat covering paper P-1 for a large number of persons must be accommodated compactly in the functional casing H provided at the rear of the seat body 11 and that the roll R allows the automatic and correct feeding of the paper P onto the seat body 11.

As shown in FIGS. 2 and 6, the paper P has perforations 80 at the central portion at specified intervals along its length so that the central portions defined by the perforations 80 can be broken and removed to make an opening that corresponds in shape to the internal contour of the seat body 11 and communicates with the interior of the flush toilet bowl 10.

The perforations 80, however, do not form a complete closed circuit and there is an unperforated part 81. When the paper P is broken along the line of perforations 80, the central broken part of the paper falls into the bowl 10 with the lower end contacting the residual water in the bowl.

The reason that the paper P is not perforated along a completely closed circuit and is interrupted by the unperforated part 81 is that, with a completely closed circuit of perforations, the rigidity of the paper P is not great enough so that the paper P will easily bend when being fed onto the seat body 11 and that it cannot be formed into a roll R. On the other hand, the paper P with the unperforated part 81 has a strength sufficient to allow the automatic feeding and winding up into a roll.

Furthermore, the unperforated part 81 of the paper P helps prevent the paper P from being caught in the feed rollers 24 or the press roller 71.

The line of perforations 80 that matches the internal contour of the seat body 11 and along which the central portion of the seat covering paper P is to be broken, may be formed entirely of perforations, or a combination of intermittent cuts and perforations.

As shown in FIGS. 2 and 6, the paper P has holes 82 for position detection along its length at specified intervals, between the unperforated part 81 and the front ends of the perforated line 80. At the central portion of the cover casing 60 corresponding to the hole 82 is provided a position detecting sensor 83.

When a specified length of the paper P is fed from the roll, the position detecting sensor 83 detects the hole 82 and stops the operation of the seat covering paper feeding mechanism C to correctly position the sheet covering paper P-1 of the paper P on the seat body 11.

Instead of using the hole 82, it is possible to mark the corresponding position on the paper P with a desired color. The position of the hole 82 is not limited to the central portion of the paper P and may be set at any desired point on the paper.

The feeding and positioning of the paper P can also be effected by counting the number of revolutions of the motor 30 with a counter and operating the control unit F according to the count, rather than using the position detecting sensor 83.

In FIG. 2, designated 84 is a seating sensor made up of a reflection type infrared sensor which is installed at the front end of the mounting base 20. When the user, after having sat on the seat body 11, leaves the seat body 11, the seating sensor 84 produces a detection signal which activates the motor 30 through the control unit F and the motor 30 axially reciprocates the cutting blade 28 instantaneously cutting the paper P to provide the seat covering paper P-1 on the seat body 11.

The seating sensor 84 may be built into the automatic seat covering paper feeding seat A or installed separately, depending on the conditions of use and environmental conditions.

As an alternative to the seating sensor 84, a load cell may be used which detects the weight of the occupant when he or she sits on the seat, activating the control unit F to cut the paper P.

In FIG. 2, denoted 85 is a sensor whose detection of the seat body 11 is interrupted when the seat body 11 is in a position where the user cannot sit on it (i.e., when the seat body 11 is uprighted), at which time the motor 30 is deenergized to stop the feeding of the paper P. Only when the seat body 11 is in a position where it can be sat upon, the sensor 85 detects the seat body 11 permitting the paper P to be fed.

The sensor 85 may be replaced with a microswitch or a limit switch.

Figure 10:
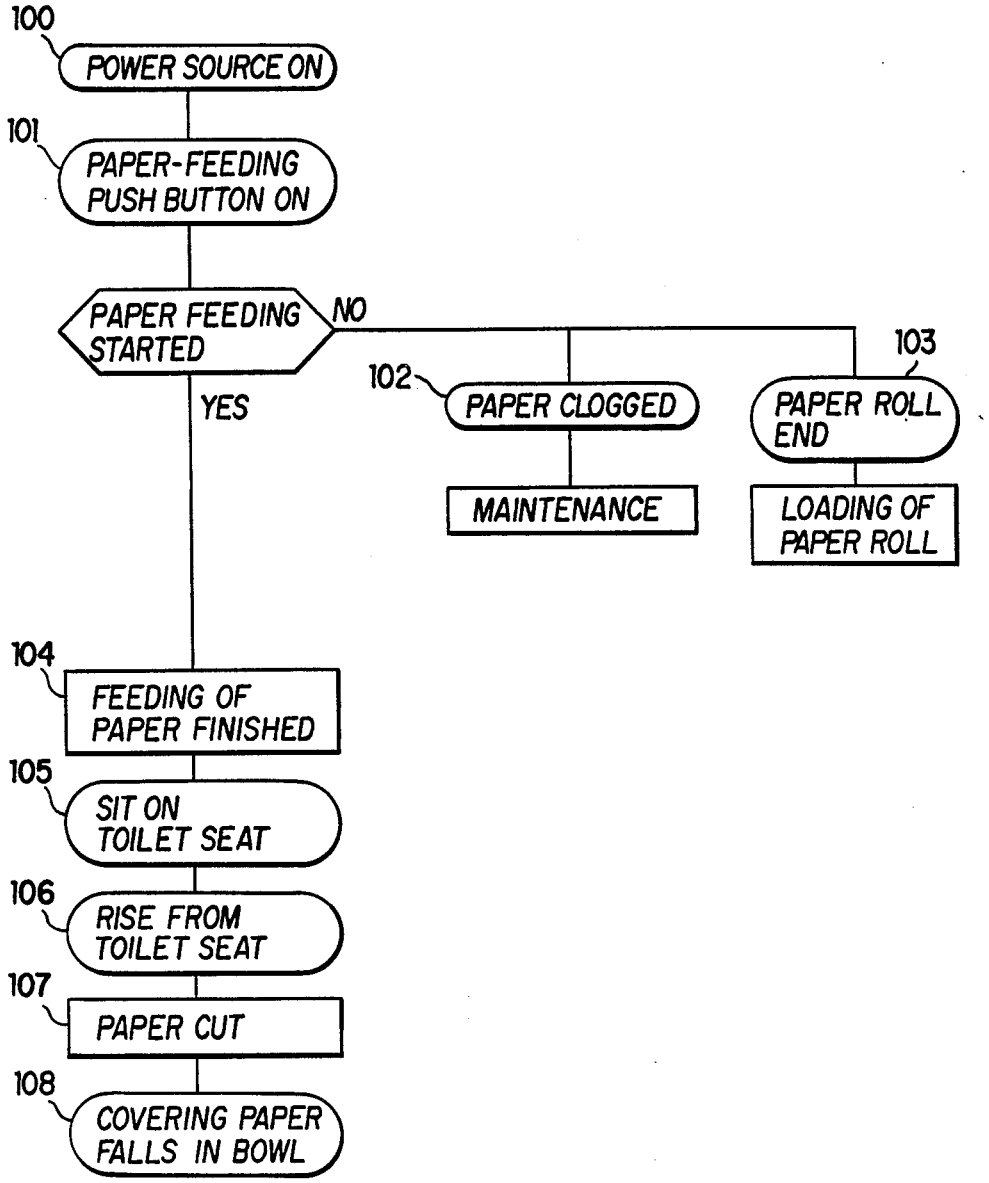
FIG. 10 is a flow chart showing the sequence of seat covering operations.

Next, we will explain the operation of the automatic seat covering paper feeding toilet seat A with the above construction by referring to the flow chart shown in FIG. 10.

First, the power switch is turned on (100) and a check is made to see if the power lamp 62 is lighted or not.

The power switch S is provided rearwardly of the front end of the mounting base 20 (see FIG. 4) as there is no need for access to the switch during operation.

After the power lamp is checked, the paper feeding pushbutton 61 is pressed (101).

At this point, when the seat covering paper is clogged or there is no seat covering paper roll R, the paper clogging lamp 64 or paper reloading lamp 63 at the control board G is lighted (102 or 103 respectively).

If there is no paper clogging and the roll R has a sufficient amount of seat covering paper P, or when the paper is removed or a new seat covering paper roll R is set in the storage box 70, the control unit F transmits operation signals to the motor 30 and the clutch mechanism M based on the paper feeding and cutting program read out from the memory of the control unit F and the motor 30 and the clutch mechanism M are actuated according to the operation signals from the control unit F, wherein the clutch mechanism M selects the gear train associated with the feed rollers 24 and the press roller 71.

As a result, the rotation of the motor 30 is transmitted through the gear train to the feed rollers 24 and the press roller 71. Since the feed rollers 24 and the press roller 71 rotate in opposing directions with the paper P held therebetween under pressure, the paper P is unwound from the seat paper roll R in the storage box 71.

In more detail, as shown in FIG. 5, the paper P is bent over upward and outward by the press roller 71 to offset the curling acquired by the paper on the roll R. The paper P then passes between the feed rollers 24 and the press roller 71 and through the slit 75 to be fed onto the seat body 11.

In the process of the paper feeding operation, when a specified length of the paper P is fed over the seat body 11, the position detecting sensor 83 detects the hole 82 provided at the central portion of the paper P and activates the control unit F to stop the motor 30. This immediately stops the feeding of the paper P by the feed rollers 24 and the press roller 71. As a result, exactly the specified length of the the sheet paper P is fed over the seat body 11 (104).

The paper P, immediately after being unwound from the roll R, is still curled up and, in this embodiment, can be relieved of the curling and further given a reverse downward curling by the press roller. The paper P is then passed downwardly curled through the slit 75 and supplied over the seat body 11.

The elimination of upward curling and application of reverse downward curling reliably a paper clogging which would be caused by the upwardly curled paper P being fed only in the functional casing H and not onto the seat body 11. This arrangement can also prevent the paper P that is being fed over the seat body 11 from curling near the slit 75 so that it cannot be supplied to the specified position.

After this, the user breaks the central portion of the paper P along the perforated line 80 with the unperforated part 81 left intact. The broken part of the hangs down into the bowl 10 with the end sinking into the water in the bowl 10.

As explained above, with this embodiment, a predetermined length of the paper P can be supplied onto the seat body 11 by a simple operation. When supplied over the seat body 11, the paper P is not immediately cut off from the roll R, so that the paper P is kept from falling from the bowl 10 and requires no positioning operation.

When the paper feeding button 61 is pressed with the paper already fed over the seat body 11, the control unit F blocks a further feed of the sheet paper P. This helps prevent the wasting of paper for fun by an ill-intentioned user. In other words, the control unit F has the capability to enable or disable a further feeding of the paper P.

Then the user sits on the paper P placed over the seat body 11 which forms the seat covering paper P-1 (105).

When, after having sat on the seat body 11 to relieve himself or herself, the user stands up leaving the seat body (106), the seating sensor 84 detects that the occupant has left the seat body 11 and activates the control unit F, which in turn activates the motor 30 and the clutch mechanism M to connect the rotating motor 30 to the cutting blade moving shaft 25 through the gear train, reciprocating the cutting blade 28 and instantaneously cutting the paper P (107) to leave the seat covering paper P-1 on the seat body 11 separately from the rest of the paper P.

In the above action, the seating sensor 84 must detect the seating condition continuously for at least 10 seconds (i.e., must detect that the user has sat on the seat for at least 10 seconds continuously) before the control unit F can be activated even when the user leaves the seat body 11.

This arrangement considers possible undersired paper cutting operations that may be caused by the sensor being erroneously activated by the paper P being fed or temporary motions of the user other than sitting.

The set timing of the seating sensor 84 and its time lag for preventing erroneous operation can be determined at a desired value by making an appropriate setting on the control unit F according to the environmental conditions.

Then, the flushing device is activated to wash the interior of the bowl 10 clean, discharging feces or urine together with the hanging portion of the seat covering paper P-1 by the pressure of the flushing water (108).

In public sites such as theaters, it is possible to arrange the control unit F to automatically feed the paper P over the seat body 11 after the above series of operations has been completed.

With the above construction and operations, this embodiment provides the following advantages.

(1) Since the feeding mechanism C and the paper cutting mechanism D are activated by the control unit F, an exactly specified length of the the sheet paper P can automatically be fed over the seat body 11 and, after use, be cut off automatically.

Paricularly at public sites, each user can draw out fresh paper P from the functional casing H, which assures the user that he is using a of clean seat covering paper.

Also since the paper P is held on the seat, the paper-covered toilet seat can be used with ease.

(2) The paper roll R, the paper feeding mechanism C, the paper cutting mechanism D, the control unit F for controlling the paper feeding mechanism C and the paper cutting mechanism D, and the control board G for transmitting control signals to the control unit F are all built into the functional casing H installed at the rear of the seat body 11, so that the seat structure with multiple functions can be made compact as a whole, providing the maximum possible useful space in the toilet room. This structure also enhances the degree of ease of handling the toilet device.

Because the toilet seat structure of this invention is compact, it can be used on any type of toilet bowl. It also can be mounted on existing toilet bowls by a simple procedure as a replacement for the old seats.

Now, we will explain other preferred embodiments and variations and their structural features in the following.

(1) The control board G is located on the right, as one faces the front of the toilet, of the automatic paper feeding toilet seat A for easy handling. The lettering is so arranged as to be naturally read when the user operates the seat device (while standing). This greatly improves the operability.

(2) In this embodiment, a reset circuit is accomodated in the control unit F of the automatic paper feeding toilet seat A to allow easy removal of the seat covering paper P fed over the seat body 11 when it is a flawed sheet or wet by drops of water adhering to the seat body 11.

That is, the reset circuit includes a reset switch 87 installed at the bottom of the front extension 20*a* of the mounting base 20. When the switch 87 is operated, the paper P can be cut at any stage of the operation sequence to initiate the operation of the automatic paper feeding toilet seat A.

(3) The safety mechanism incorporated in this embodiment consists of a sensor (not shown) which detects that the cutting blade 28 has been completely contained in the cover casing 60 before stopping the operation of the apparatus, to ensure safety during maintenance.

(4) The cutting of the paper P is done in the functional casing H to assure safety for the user. Also the paper P is protected against water droplets as it is not exposed outside of the functional casing H.

(5) In this embodiment, the feeding of the paper P may also be performed semi-automatically, i.e., the paper P is slightly fed from the slit 75 automatically and is taken out and positioned over the seat body 11 by hand.

This method obviates the position detecting hole 82 in the paper P.

The position detecting sensor 83 can be eliminated by utilizing a counter of a desired type to count the number of revolutions of the motor 30 and determine the position of the paper P and by activating the control unit F according to the count obtained.

Where the semi-automatic operation is employed, the toilet seat structure is so constructed as to lock the paper P after fed an appropriate length thereof has been fed.

When the feed length of the paper P is not appropriate so that the paper P is not locked by the control unit F, the control unit F disables the next step of automatically cutting the paper P and prevents it from being triggered by the seating sensor.

(6) It is also possible to perforate the paper P along transverse lines so that an individual section thereof for each use (namely, the seat covering paper P-1) can easily be cut off by the weight of the occupant when he or she sits on the seat body 11.

This obviates the seat covering paper cutting mechanism D, allowing greater room for the design of the seat construction.

(7) Since the electronic components (such as control unit F and control board G) are arranged on one side and contained in the functional casing H, the toilet seat structure is improved in water resistance and electrical insulation or safety.

(8) The paper roll storage section is competely separated from the sheet paper feeding mechanism C and the paper cutting mechanism D to ensure electrical safety and prevent an injury by the cutting blade 28 when the paper roll R is replaced.

(9) The slit 75 formed in the upper part of the cover casing 60 through which the paper P is taken out is provided with an inclined surface to prevent water from contacting the paper P as much as possible.

For the same reason, the storage position of the paper roll R is located above the slit 75.

(10) A microswitch is provided on the cover casing 60 to detect the setting condition of the paper roll storage box 70. With the seat covering paper roll storage box 70 removed or inappropriately set, the microswitch renders the control unit F inoperable even when the paper feeding button 61 is pressed, to ensure safety during maintenance and prevent erroneous operation. The detecting means is not limited to the microswitch and may consist of a sensor or limit switch.

(11) From considerations of appearance and serviceability, the paper roll storage box 70 has its front side made slidable and held open by a hook and its rear side rigidly secured by screws.

(12) The press roller 71 mounted in the paper roll storage box 70 is released from the paper roll R by a slide mechanism to facilitate the replacement of the roll R.

When the press roller 71 is set in the paper roll storage box 70, a spring is used to keep the press roller 71 locked in position.

(13) The end of the connecting plug 72 is tapered to permit easy alignment between its center and the center shaft of the paper roll R.

(14) The connecting plug 72 may be mounted not only through O-rings but by an L-shaped hook. It may also be mounted onto the side walls 70*a*, 70*b* of the paper roll storage box 70.

(15) In the embodiment shown, the automatic seat covering paper feeding toilet seat A is of a fully automatic type that can be attached to the seat of ordinary type. It is also applicable to other types of toilet seats such as those having a heater device, a bidet or running water nozzle, or a perfuming device.

Furthermore, the toilet seat A of this invention may be completely separated from the functional section 13 which can be installed at the back of the wall to obtain a better appearance and a larger space in the toilet room.

Also, a remote control device may be used to remotely control the seat A.

Figure 11:
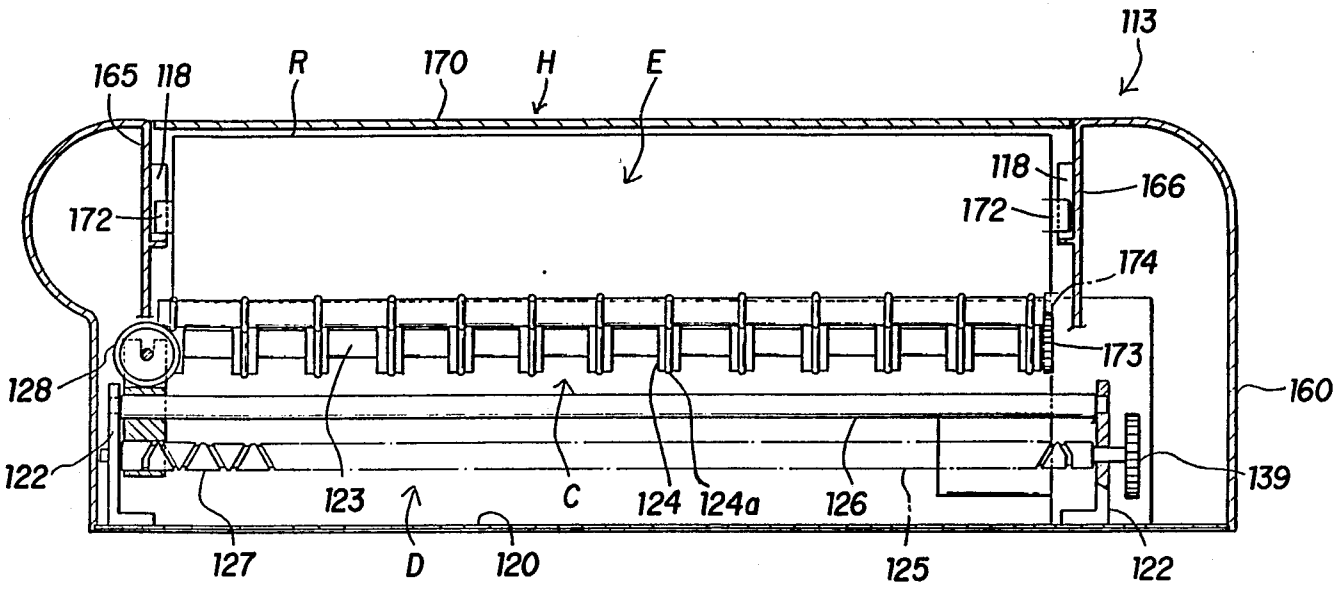
FIG. 11 is a partially cutaway front view of another modification of the toilet seat structure.
Figure 12:
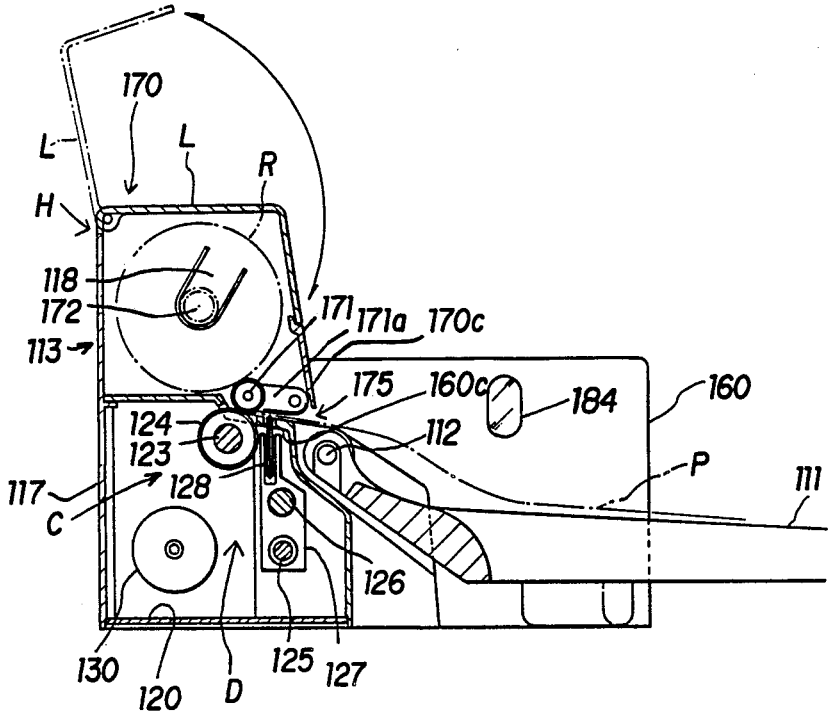
FIG. 12 is a partially cutaway left side view of the above modification of the toilet seat structure with the lid opened in a forward direction.

A modification of the above toilet seat structure A is shown in FIG. 11 and FIG. 12 and such modification is characterized by further comprising a paper clamping mechanism I.

Another modification of the above toilet seat structure is shown in FIG. 11 and FIG. 12 and such modification is characterized by comprising a casing lid L which can be readily opened. In this modification, like parts which appear in the toilet seat shown in FIG. 1 to FIG. 10 are denoted with like numerals but higher by 100.

As shown in the drawings, a paper storing box 170 comprises (a) a pair of left and right side walls 165, 166, (b) a rear wall 117 which is integrally connected with the mounting plate 120 between the pair of left and right side walls 165, 166 and (c) and L-shaped casing lid L which has a proximal end thereof pivotally connected to the upper end of the rear wall 117 and distal end thereof in contact with a front wall 170*c* of the paper roll storing box 170.

Figure 13:
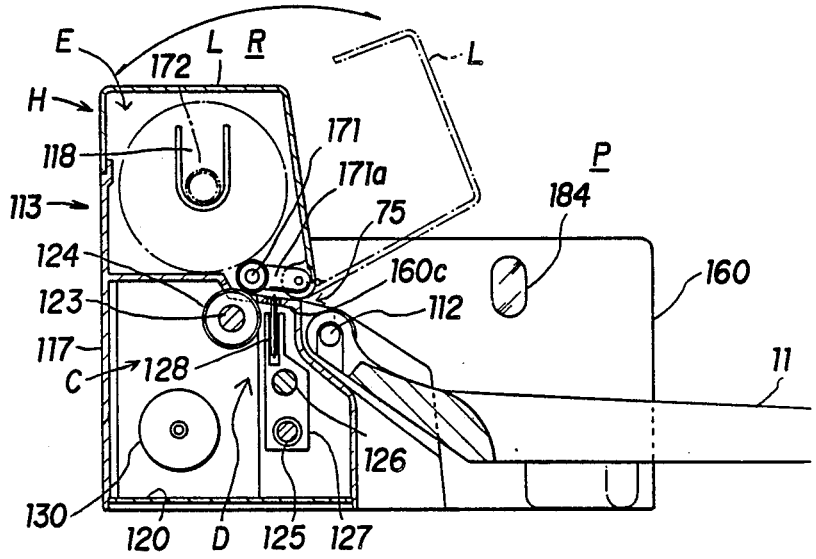
FIG. 13 is a partially cutaway left side view of the above modification of the toilet seat structure with the lid opened in a backward direction.

In the above construction, on the inner surface of the left and right side walls 65, 66 of the paper roll storing box 170, respective U-shaped grooves 118, 118, which are slanted in the embodiment of FIGS. 12 and 13, are formed and each groove 118 has one end thereof opened toward the upper portion of the paper roll storing box 170 and other end thereof extended toward the central portion of the left and right side walls 165, 166.

Due to such construction, by inserting a pair of connecting plugs 172, 172 which are fixed to the both ends of the paper roll R into and along the slanted grooves 118, the paper roll R can be snugly stored in the paper roll storing box 170.

On the other hand, by opening the casing lid L, the paper roll R can be readily removed from the paper roll storing box 170 and replaced with a new paper roll R.

Furthermore, although the casing lid L is constructed so as to open in a forward direction in FIGS. 11, 12, the casing lid L is constructed so as to open in a backward direction as shown in FIG. 13.

Figure 14:
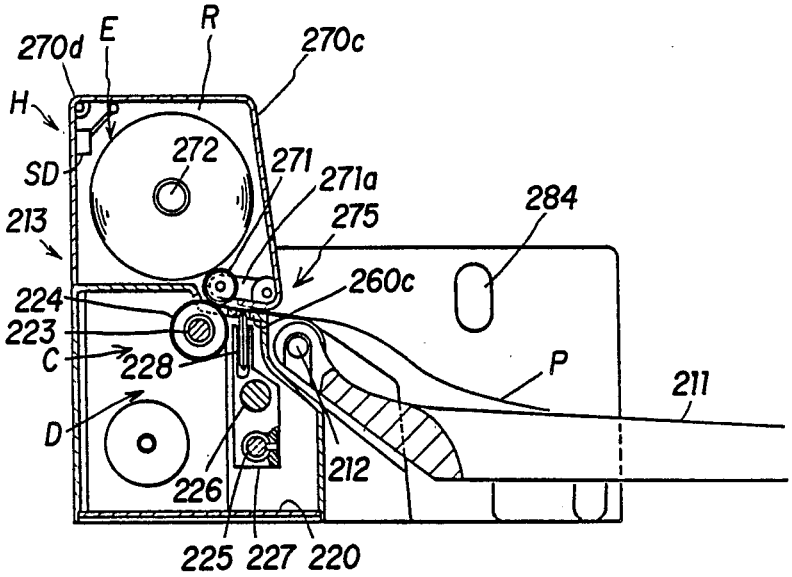
FIG. 14 is a partially cutaway left side view of still another modification of the toilet seat structure.
Figure 15:
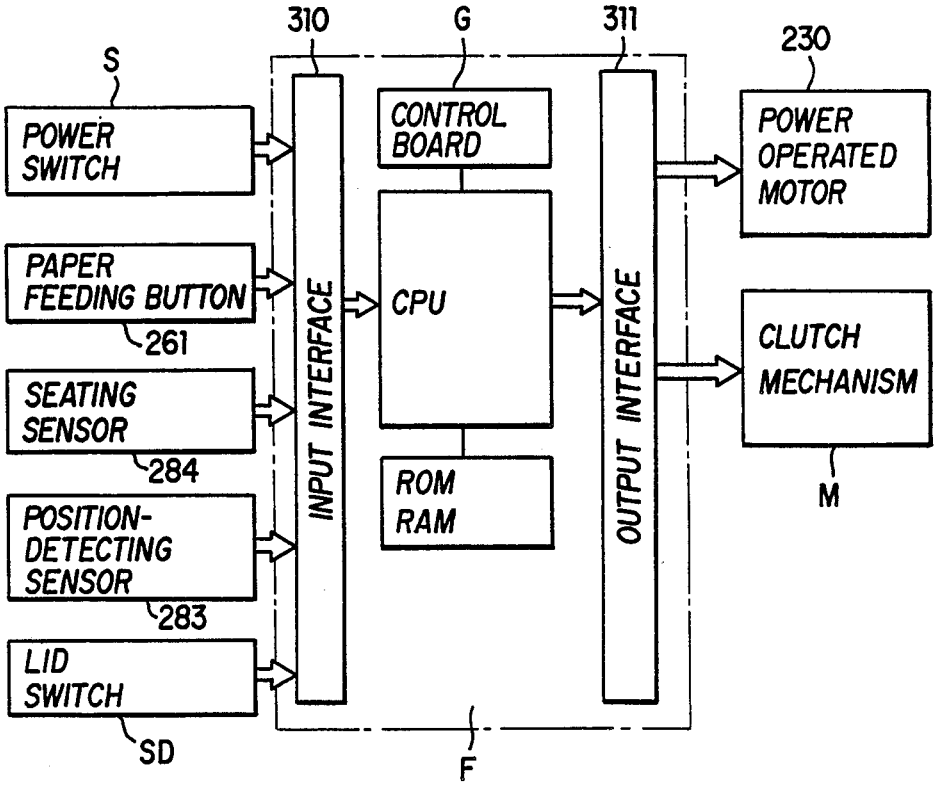
FIG. 15 is a block diagram of the control unit of this embodiment.

Still another modification of the above toilet seat structure is shown in FIG. 14 and FIG. 15 and such modification is characterized by further comprising a power off switch SD for safety purpose. In this modification, like parts which appear in the toilet seat shown in FIG. 1 to FIG. 10 are denoted with like numerals but higher by 200.

As shown in FIG. 14, the functional casing H comprises a casing lid **270*c* which is pivotable on a pivot shaft 270*d* and a lid switch SD which is mounted on the upper end of the casing H adjacent to the pivot shaft 270*d***.

The lid switch SD is activated corresponding to the opening or closing of the casing lid **270*c* and when the casing lid 270*c*** is opened, an output signal is transmitted to the control unit F to stop at least the supply of electricity to the paper feeding mechanism C and the paper cutting mechanism D.

Accordingly, during the replacing operation of the paper roll R from the paper roll storing box 270, an accident such as the catching of a finger in the sheet paper feeding mechanism C or cutting of a finger by the paper cutting mechanism D can be effectively prevented, thus enhancing the safety of the paper roll replacing operation.

Of course, it is possible to stop the supply of electricity to other parts or constituents of the toilet seat of the present invention such as the contorol unit F or the control board G by the activation of the lid switch SD.

In the drawing, a microswitch is used as the lid switch SD, other contact-type switches and non-contact-type switches can be used as the lid switch SD.

We claim:

1. A toilet seat structure which comprises:

(a) a toilet seat body having an upper surface;

(b) a functional casing provided at the rear of the toilet seat body;

(c) a paper roll storage box disposed in the functional casing at an upper portion thereof and rotatably stored in the storage box a paper roll having a length of paper sufficient for being cut into a plurality of seat covering papers, the paper having a free end beginning with which the paper is unreelable from the roll;

(d) a paper feeding mechanism for feeding paper in a forward direction toward said toilet seat body by unreeling the paper from the paper roll and extending the paper forwardly onto the upper surface of the toilet seat body, said paper feeding mechanism being disposed in the functional casing immediately below the storage box, said paper feeding mechanism including a feed roller and a press roller biased together to form a nip through which the paper is conducted from the paper roll, the feed roller and the press roller being so arranged that the paper before entering said nip travels on a substantial portion of the surface of the press roller in a direction opposite the direction of winding of the paper on the paper roll to offset curl imparted to the paper by the roll so that the paper is flat when extended onto said upper surface of the seat body;

(e) a paper cutting mechanism disposed in the functional casing in front of the paper feeding mechanism, said paper cutting mechanism being located to cut the paper at a position a predetermined distance rearwardly away from the free front end of the paper to provide a flat piece of seat covering paper on the toilet seat body;

(f) a control unit comprising a central processing unit for accurately controlling the operation of the paper feeding mechanism and the paper cutting mechanism to feed a specified length of the paper onto the toilet seat body and cut the paper fed onto the toilet seat body to provide a seat covering paper on said toilet seat body; and (g) a control board for transmitting control signals to the control unit.

2. A toilet seat structure according to claim 1, wherein the paper roll storage box comprises a lid switch which is activated by an opening or closing of said casing lid and said lid switch transmits an output signal to the control unit to stop the supply of electricity to at least said paper feeding mechanism and said paper cutting mechanism.

* * * * *